US007152973B2

(12) United States Patent
Hann et al.

(10) Patent No.: US 7,152,973 B2
(45) Date of Patent: Dec. 26, 2006

(54) INKJET RECEIVER MEDIA

(75) Inventors: Richard Anthony Hann, Ipswich (GB); Barry Pack, Ipswich (GB)

(73) Assignee: Imperial Chemical Industries PLC, London (GB)

( * ) Notice: Subject to any disclaimer, the term of this patent is extended or adjusted under 35 U.S.C. 154(b) by 0 days.

(21) Appl. No.: 10/473,233

(22) PCT Filed: Mar. 25, 2002

(86) PCT No.: PCT/GB02/01443

§ 371 (c)(1),
(2), (4) Date: Sep. 29, 2003

(87) PCT Pub. No.: WO02/078967

PCT Pub. Date: Oct. 10, 2002

(65) Prior Publication Data

US 2004/0101639 A1 May 27, 2004

(30) Foreign Application Priority Data

Mar. 30, 2001 (GB) ..... 0107989.6

(51) Int. Cl.
*B41J 2/01* (2006.01)

(52) U.S. Cl. ..... 347/105; 347/101; 428/32.1

(58) Field of Classification Search ..... 347/105, 347/101, 100, 96, 95; 428/195, 32.1, 32.6; 427/1

See application file for complete search history.

(56) References Cited

U.S. PATENT DOCUMENTS

| | | | | |
|---|---|---|---|---|
| 3,425,830 | A * | 2/1969 | Sanders | 430/87 |
| 5,747,146 | A * | 5/1998 | Kashiwazaki et al. | 428/195.1 |
| 5,882,388 | A * | 3/1999 | Adair et al. | 347/105 |
| 6,197,381 | B1 * | 3/2001 | Saito et al. | 427/374.3 |
| 6,447,111 | B1 * | 9/2002 | Gallo et al. | 347/101 |
| 6,541,070 | B1 * | 4/2003 | Magoshi et al. | 427/407.1 |
| 2003/0108690 | A1 * | 6/2003 | Sadasivan et al. | 428/32.1 |
| 2003/0113516 | A1 * | 6/2003 | Wang et al. | 428/195 |

FOREIGN PATENT DOCUMENTS

| | | | |
|---|---|---|---|
| EP | 0 818 321 | A | 1/1998 |
| EP | 818321 | A1 * | 1/1998 |
| EP | 0 983 867 | A | 3/2000 |
| WO | WO 00/71360 | A | 11/2000 |
| WO | WO 00/71360 | A1 * | 11/2000 |

* cited by examiner

*Primary Examiner*—Manish S. Shah
(74) *Attorney, Agent, or Firm*—Morgan Lewis & Bockius LLP

(57) ABSTRACT

A receiver medium for inkjet printing includes a porous substrate, having on at least one surface thereof a porous ink-absorbent coating having a colloidal particulate material, a water-insoluble liner binder polymer, and optionally a film forming polymer dispersion. On printing, the medium rapidly absorbs ink to give a touch-dry surface. The receiver medium can also have a satin finish surface. Also disclosed is a method of making the receiver medium.

2 Claims, 1 Drawing Sheet

INKJET RECEIVER MEDIA

FIELD OF THE INVENTION

Figure 1:
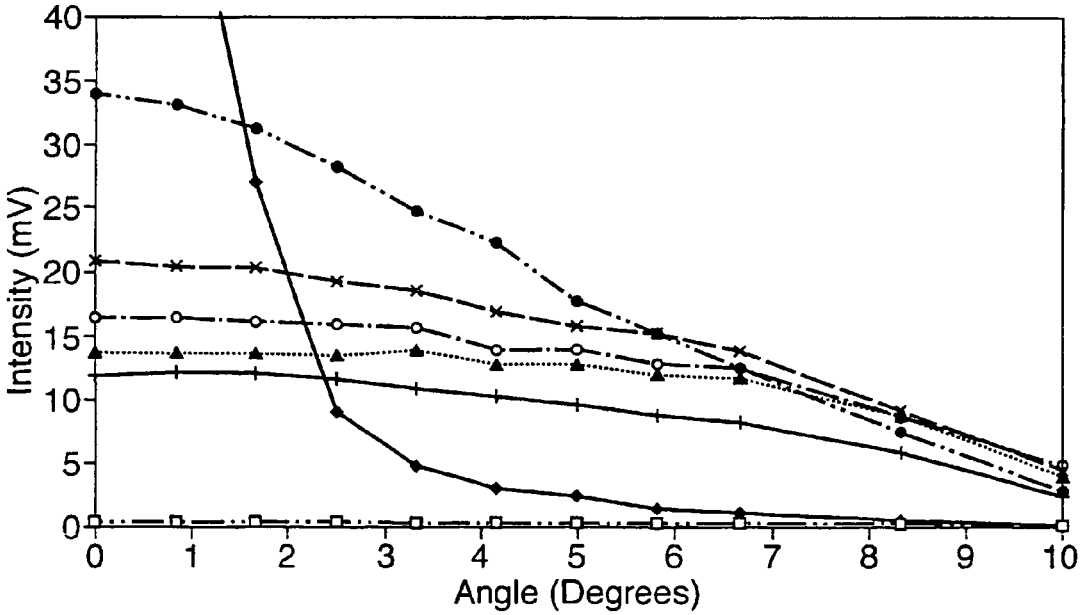

This invention relates to inkjet receiver media, and concerns a receiver medium for inkjet printing and a method of making the medium.

BACKGROUND TO THE INVENTION

An inkjet printing process uses an array of nozzles to deposit droplets of ink at precisely controlled positions on a receiver medium. The process may be used to print text, patterns or images, or a combination of the above. The quality of the print obtained depends in part on the interaction between the ink droplets and the receiver medium and the way in which the latter controls their movement. The inks used are typically an aqueous solution of dyes, with additional components to control evaporation, viscosity and other physical properties. The inks can also be based on pigments rather than dyes and can be carried in an oil-based rather than a water-based vehicle. Typically, the ink colours used are cyan, magenta, yellow and black. For the highest quality printing of images, additional inks are often used. These are typically pale cyan and pale magenta, thus allowing a greater degree of control over the colour while increasing the volume of ink that must be deposited.

There have been two main trends in inkjet technology over the last few years. One has been the capability of providing high quality prints that rival photographs in their appearance. The other is a trend towards faster printing. Both these changes increase the demands on the receiver media. In order to provide a photograph-like appearance, the media must provide excellent control over the absorption of the incoming ink drops, thus retaining the precision with which the drops have been applied. The difficulties are compounded by the trend towards faster printing, as there is less time in which to control the drops, and also less time for the print to stabilise as it comes out of the printer.

It is possible to print onto plain cellulosic paper using inkjet technology. This has the benefit of offering rapid absorption of the ink, so that the prints are dry as soon as they leave the printer. However, because the paper surface is made up of fibres, it is very irregular in nature, and in particular, the fibres combine to form a matrix of capillaries, which rapidly transport the ink in a range of directions, including the plane of the paper itself. This phenomenon is known as "wicking". There are two consequences of this: the edges of a printed area appear very irregular, as they reflect the irregularities of the paper. In addition, a large proportion of the ink is drawn below the surface of the paper, so that it is obscured by one or more fibres. This effect leads to prints that appear dull and desaturated, as there is a scattering layer of paper fibres obscuring the dyes that make up the image. The image is also easily damaged by exposure to water.

Porous coatings consisting of porous inorganic particles and a polymeric binder can be applied to plain paper in order to smooth out the irregularities of the fibres and provide improved fixing, while still giving rapid absorption of the ink, as exemplified in U.S. Pat. No. 4,877,678. Such papers give greatly improved control of the ink droplets after arrival at the paper surface, because of their uniformity and the ability to prevent the rapid transport of the ink in a few arbitrary directions. They also increase the brightness of the image, because the dye is prevented from penetrating too far below the surface. A bigger increase is available from the use of finer (approximately 1 micrometer) inorganic particles and an organic binder, as in European Patent specification No. 0495430A1. However, the matt finish limits the brightness of the image and is unsuitable for applications such as electronic photography.

In order to make prints on transparent media, e.g. for overhead projection purposes, it is necessary to apply a coating capable of absorbing the necessary volume of liquid onto a transparent support. Such a coating typically consists of a polymer composition that exhibits controlled swelling in water, as exemplified in European Patent specification No. 0009440A1. Because the swelling process is based on diffusion and is therefore slow, it is necessary to print such media slowly in order to allow time for absorption of the ink. If the ink is delivered too quickly, a phenomenon known as "puddling" occurs, in which neighbouring droplets of ink combine on the surface of the print before being absorbed. In this way, the precision of the print is greatly reduced, and the overall appearance suffers. It is quite usual for prints on swelling polymers to be still tacky on exiting the printer, and even for the ink to be capable of transferring onto a piece of plain paper placed in contact. Such coatings can be applied to white substrates (e.g. white polyester film) or to paper that has optionally been made impermeable by prior coating with a polyolefin in order to make glossy prints of much higher brightness than those obtained on plain paper. However, such media must be printed slowly and often require additional drying time after leaving the printer, because they lack the porosity of the absorbent media.

Solutions have been proposed to enable the achievement of a glossy, fast ink absorbing porous structure in two ways, both with inherent processing disadvantages:

(1). It is known in the art to gel an aqueous polymer solution based on a silica dispersion by a gradual chilling process, such that a glossy, porous surface is achieved, as described in European Patent specification No. 0813978A1 and European Patent specification No. 0888904A1. However, this process is slow and requires the use of specialist photographic coating machines. It is believed that in this known process, solidification is driven by cooling, and not by loss of water. Indeed, it is difficult, if not impossible, to achieve the necessary surface flatness that is required for a gloss finish by a normal drying process applied to aqueous polymer solutions based on silica dispersions suitable for forming coatings which rapidly absorb ink.

(2). Coating formulations have also been proposed which are capable of forming dried porous coatings which can be differently processed to give a flat glossy surface, as described in European Patent specification No. 0803375B1. This method involves forming the coating on the substrate, pressing the coated surface against a smooth surface, and finally peeling away the substrate to reveal a flattened glossy surface. Alternatively, the coating may be separately applied to a smooth glossy surface, dried in situ, and then a suitable substrate attached. The coating may be partially dried before application to the flat glossy surface, as described in European Patent specification No. 0685344B1. This assembly may then be peeled away from the smooth casting surface. This latter method disadvantageously involves an additional processing step.

The media produced by both these processes give prints that are dry immediately they leave the printer, are free from puddling and wicking, and have very bright colours. The bright colours appear because the dyes are fixed in the upper layers of the media. These layers are highly transparent and therefore do not obscure the dyes. The glossy surface also allows the full strength of the colours to be appreciated. In the case of (1) above, it is also possible to produce a surface texture.

The media described in (1) and (2) above are particularly suitable for printing of electronic photographs, but suffer from the disadvantage of being difficult to make and therefore expensive. Also, the high gloss of these materials makes them unsuitable for viewing under conditions where reflections from light sources will obscure the image.

Silver halide prints with a surface intermediate between matt and glossy are usually known as "semi-glossy", "silk" or "satin" finish, and henceforth the finish will be referred to as "satin". This surface is particularly favoured for viewing under highly reflective conditions. The colours obtained are nearly as bright as those from prints with a glossy finish, and the satin finish is favoured by many photographers on aesthetic grounds. Inkjet receiver media with this type of finish are well known and commercially available. However, these media have a swelling coating of the kind described earlier. They are therefore very slow to dry and are unsuitable for use with fast modern printers.

The media described in (1) may also be provided with a satin finish as described in European Patent specification No. 1044823 A2. This is accomplished by coating onto a substrate that has been sealed with a polyethylene layer that was subsequently embossed or otherwise treated in order to produce the desired profile. Such media show rapid absorption and bright colours, but are expensive to manufacture.

There does not appear to be any standard definition of a satin finish. It is well understood that the gloss measured for a satin finish surface will be intermediate between that of a gloss surface and a matt surface, but a surface with an intermediate gloss would not necessarily be described as satin. Visual inspection of satin surfaces indicates that they have light reflectance properties such that the reflected beam extends over a range of angles, whereas a normal gloss surface concentrates the light in a very narrow range of angles. Conventional glossmeters are designed to accept only a narrow range of angles from the reflected beam, and thus register a low gloss for satin-finish materials.

Inkjet receiver media require not only to meet the appearance criteria discussed above, but also must have appropriate tactile qualities. In particular, the surface should not feel sticky, rough or powdery. The swelling polymer coatings in particular tend to have a sticky feel, unless they are loaded with large filler particles, which then tend to make them feel rough.

SUMMARY OF THE INVENTION

In one aspect, the invention provides a receiver medium for inkjet printing, comprising a porous substrate having on at least one surface thereof a porous ink-absorbent coating comprising colloidal particulate material and water-insoluble linear binder polymer.

Because the coating is porous (which can be achieved by having a sufficiently high ratio of colloid to binder polymer to provide a voided coating), in use of the receiver medium, ink can be rapidly absorbed into the coating and the porous substrate, giving a touch-dry surface immediately after printing.

Provided the substrate has suitable surface properties (as will be discussed below) the medium has a satin finish surface. Such a surface gives images almost as bright as those available with a glossy finish, but is much less prone to unwanted reflections from windows and other light sources.

In a preferred aspect, the invention thus provides a satin finish receiver medium for ink-jet printing, comprising a porous substrate having on at least one surface thereof a porous inks absorbent coating comprising colloidal particulate material and water-insoluble linear binder polymer.

The receiver medium in accordance with the invention can have a 60 degree gloss, measured on a Dr Lange Glossmeter of between 8 and 25%, preferably between 10 and 15%. The satin finish can be further characterised by a measurement of light reflected from a narrow beam with an incident angle of 74 degrees. The reflected intensity at the corresponding angle of 74 degrees is compared with the reflected intensity at 5 degrees displacement from that (i.e. 69 degrees). The ratio of the first measurement to the second one should preferably be no greater than 2.

The substrate is generally in the form of a film or a sheet. The substrate is typically paper, but may be a synthetic fibre-based paper or a synthetic porous paper-like film. The substrate is usually opaque (for production of white-based prints) but may alternatively be translucent or transparent (for production of images to be back-lit or projected), such as the porous translucent material known as Teslin (Teslin is a Trade Mark) from PPG. A wide range of suitable substrate materials is available commercially.

Selection of a suitable substrate to provide a satin finish, as discussed above, can be carried out experimentally, and many papers are suitable for the practice of this invention. However, very rough papers with highly absorbent surfaces are unsuitable because the coating solution penetrates very rapidly and leaves a rough surface without the desired satin finish. Very highly glazed papers with non-absorbent surfaces are unsuitable because neither the coating solution nor the ink can penetrate sufficiently rapidly. Papers with a matt coating designed for use in inkjet printing may be particularly suitable. Such a coating can be chosen from any of those known in the art.

Receiver medium in accordance with the invention can be made by applying a suitable coating liquid to the porous substrate. Conventional coating techniques may be used, such as direct or reverse gravure, Meier bar coating, bead coating, slot coating, etc. The coating is conveniently then dried in an oven, with no requirement for contact with a glazing roller. The media produced in this way may, after conversion to suitable size sheets, be used directly for inkjet printing. Optionally, a further coating may be applied to the reverse side of the substrate in order to control curl or to improve feeding into the printer. Further coatings may be applied to the receiving surface before or after the main coating. These may be to modify properties such as water and light fastness using agents known for these purposes.

The coating liquid typically comprises a solution of the binder polymer (non-aqueous as the binder polymer is water insoluble) mixed with colloidal particulate material (and optional film-forming polymer dispersion in preferred embodiments, as discussed below).

In a further aspect, the invention thus provides a method of making a receiver medium for inkjet printing, comprising providing at least one surface of a porous substrate with a porous ink-absorbent coating comprising colloidal particulate material and water-insoluble linear binder polymer.

The choice of suitable colloidal particulate material is dependent on whether the receiver medium is intended for use with dye-based inks or pigment-based inks. As discussed above, dye-based inks are typically an aqueous solution of dyes, whereas pigment-based inks are typically an oil-based vehicle of pigments.

If a receiver medium in accordance with the present invention is to be used with dye-based inks, the colloidal particulate material preferably has a mean particle diameter of less than 120 nm, more preferably less than 60 nm, and most preferably about 25 nm. Coatings prepared from larger particle sizes and printed with dye-based inks give increased light scatter and the larger particles tend to obscure the image. Very small particle sizes reduce the rate of ink absorption and lead to the appearance of visually obvious cracks.

Different considerations apply to a receiver medium printed with pigment based inks, where the pigment particles of the inks can remain unabsorbed on the surface of the receiver medium and may therefore be easily rubbed off e.g. by mechanical abrasion. Thus, if a receiver medium in accordance with the present invention is to be used with pigment-based inks, it is preferred to use colloidal particulate material with larger particle sizes, preferably having a mean particle diameter in the range 60 to 120 nm, and more preferably about 100 nm.

The colloidal particulate material is preferably an inorganic material, and may be any readily available colloidal material such as silica, alumina or zirconia. Especially preferred is silica, optionally with cationic surface modification. The solids content is usually 20 to 50% by weight, typically 40%. Suitable colloidal particulate materials are commercially available, such as Bindzil 40/130 (Bindzil 40/130 is a Trade Mark) which is a silica colloid with 25 nm average particle diameter and 40% by weight solids, manufactured by Eka Chemicals AB, Nyacol DP 3890 (Nyacol DP 3890 is a Trade Mark) which is a colloidal silica with 50 micrometer particle diameter and 50% solids manufactured by Eka Chemicals AB and Bindzil Z40K (Bindzil Z40K is a Trade Mark) which is a colloidal silica with 100 nm average particle diameter and 40% by weight solids, manufactured by Eka Chemicals AB. Instead of such inorganic colloidal material, a polymeric colloidal material can optionally be used. This is in the form of a latex with a film forming temperature (MFFT) of greater than 80° C., preferably greater than 100° C., most preferably greater than 120° C. The oven temperature used for drying a coating based on such a latex must be less than the MFFT.

The binder polymer is linear, i.e. non-cross linked, and functions to bind the colloidal material to the substrate. Preferably the polymer chain contains a preponderance of water-insoluble groups, such as styrene, copolymerised with a monomer such as maleic anhydride capable of providing carboxylic acid groups. Thus, the binder polymer is desirably a copolymer of a hydrophobic monomer and a monomer with carboxylic acid functionality and soluble in dilute aqueous ammonia. The polymer is preferably an acrylic copolymer or a styrene maleic anhydride copolymer with an acid value of less than 405.

Such polymers are commercially available, e.g. as Scripset 540 (Scripset 540 is a Trade Mark) which is a styrene/maleic anhydride copolymer with an acid value of 185 (mg KOH per g polymer) made by Monsanto. Alternatively, the binder polymer may comprise a copolymer of water-insoluble and carboxylic acid-containing acrylic monomers. Examples of commercially available polymers of this sort include Carboset 525 (Carboset 525 is a Trade Mark) which is an acrylic copolymer of acid value of 80 (mg KOH per g polymer) manufactured by BF Goodrich, and Surcol 441 (Surcol 441 is a Trade Mark) which is an acrylic copolymer with an acid value of 120 (mg KOH per g polymer) manufactured by Ciba. Such polymers are soluble in basic solution, e.g. in ammonia, low molecular weight amines etc, but insoluble in water, and when in solution have surfactant properties that aid the wetting of the substrate. If a volatile base, e.g. ammonia, is used to dissolve the polymer, the base is lost during the drying of the coating, so that the remaining material is insoluble in water. The binder polymer is essential to give the coatings structural integrity. We believe that it is advantageous to use a negatively charged binder polymer as described above in order to minimise flocculation of a negatively charged colloid such as silica, so the binder polymer is preferably anionic in character. A further basic material such as sodium hydroxide may optionally be added in order to adjust the pH in the coating solution.

The porous ink-absorbent coating desirably further includes a film-forming polymer dispersion. This dispersion may take the form of a latex, and preferably contains basic groups especially when the substrate comprises paper that has not received prior treatment in order to enable dye fixing (as discussed further below). Suitable polymer dispersions are commercially available, such as the polymer latex DP6-6307 (DP6-6307 is a Trade Mark) which is an acrylic latex with basic functionality manufactured by Ciba Speciality Chemicals Ltd. Other suitable polymer dispersions include Vylonal MD 1400 (Vylonal MD 1400 is a Trade Mark) which is a 15% dispersion of a polyester polymer in water, manufactured by Toyobo. The latex is preferably an acrylic copolymer comprising tertiary amino groups.

The film-forming polymer dispersion typically has a particle size 150 nm or less, and has a glass transition temperature of less than 20° C. The solids content of the dispersion is usually 20–50%, typically 30%.

Typical compositions depend on whether the film-forming polymer dispersion is present or not. In the absence of such polymer dispersion, the weight ratio of colloid to binder polymer may be 10:1 to 80:1, preferably 25:1 to 60:1. If film-forming polymer dispersion is also present, then the ratio of colloid to binder polymer is reduced to 3:1 to 30:1. In general, the optimum level of binder polymer will depend on the polymer dispersion concentration. Thus, a ratio of 10:1 colloid to film-forming polymer dispersion (based on weight of solids) will be balanced by a 10:1 ratio of colloid to binder polymer.

In these coatings, there is insufficient film-forming polymer dispersion and binder polymer to fill the voids between the spherical colloid particles. The coating therefore has a porous structure that allows rapid absorption of the ink droplets as they arrive in use and therefore provides good control on the precision of the image. Ideally the coating should be free of cracks, and by using colloids of a particle size greater than about 50 nm it is possible to achieve this. However, the larger particles tend to cause more scattering of light and therefore give duller colours in the image, unless printing is to be carried out using pigment-based inks. It is helpful to compromise with an array of microscopic cracks that are invisible to the naked eye. Provided that absorption through the uncracked regions of the coating is sufficiently rapid, these do not interfere with the quality of the image.

Coatings with the desired finish can be obtained from mixtures of colloids and binder polymer. Such coatings, however, tend to give prints with relatively weak colour, unless very low proportions of binder polymer are used, and the addition of the film-forming polymer dispersion is necessary to give brightly coloured prints, unless the surface of the substrate has previously been modified with a dye-fixing coating. We believe that the function of the film-forming polymer dispersion may be partly to control the penetration of the solution into the substrate and also to trap the dye molecules when there are basic groups present in the polymer dispersion. Because the optimum level of binder polymer is higher in the presence of the film-forming polymer dispersion, it is desirable to use all three components in the formulation, as the coatings can otherwise be fragile and produce excessive dust when cut into sheets.

Coatings made only from colloid and polymer dispersion generally show fairly good image quality, but have poor tactile qualities. The surface tends to feel powdery and highly lubricated. We believe that this may be due to the presence of fine particles on the surface, possibly due to flocculation of the colloid in the absence of the binder polymer. Thus we have found that the essential components are a colloid and a binder polymer with the same sign of charge when coated onto a medium with some fixing properties. A further addition of film-forming polymer dispersion is necessary in order to obtain good fixing when coated onto a plain substrate, and may be desirable in order to improve the strength of the coating when applied to a prepared substrate.

When these coatings are applied to one side of a substrate such as cellulosic paper, the resultant media are found to be curled-towards the coated side. This is an expected consequence of a single sided coating, and can be removed by one of the methods well known in the art, by suitable treatment of the back surface of the substrate. Suitable methods include hydration of the back surface using steam or water, by coating a polymer solution onto the back surface, or by coating the inkjet absorber layer onto the back surface as well as the front.

The coating thickness is typically in the range 10 to 50 micrometers, preferably about 20 micrometers.

Although the receiving media are primarily intended for the production of white-based prints their use is not so limited. For example, if a translucent or transparent porous support is used, the resulting images may be back-lit or projected. It is also possible to use the media in conjunction with other printing technologies such as thermal transfer or electrophotography.

The invention will be further described, by way of illustration, in the following Examples and with reference to the accompanying drawing in which:

FIG. 1 is a graph of intensity (mV) versus angle (degrees), showing results of laser reflection measurements (blank subtracted) for various different inkjet receiver media, with results for a commercially available satin finish inkjet paper (Commercial Satin 1) shown by filled circles, a commercially available satin finish inkjet paper (Commercial Satin 2) shown by vertical dashes, a glossy film shown by filled diamonds, a matt paper shown by empty squares, receiver medium of Example 1 shown by filled triangles, receiver medium of Example 2 shown by crosses and receiver medium of Example 3 shown by empty circles.

In the Examples, all percentages are by weight unless otherwise specified. Further, a Stylus Photo EX printer (Stylus Photo EX is a Trade Mark) (manufactured by Epson) using dye-based inks is employed unless otherwise specified.

EXAMPLE 1

A binder polymer solution was prepared by vigorously stirring the following until dissolved:

| | |
|---|---|
| Water | 1.37 kg |
| Binder polymer (Carboset 525) | 175 g |

-continued

| | |
|---|---|
| Ammonia (0.91 S.G.) | 117 g |
| Sodium hydroxide | 6.7 g |

The silica sol was added to the binder solution prepared above, slowly with vigorous stirring:

40% silica sol (Bindzil 40/130) 4.3 kg

Finally, the polymer dispersion was slowly added with vigorous stirring:

Polymer latex (DP6-6307) 698 g

Carboset 525 is an acrylic copolymer of acid value of 80 (mg KOH per g polymer) manufactured by B F Goodrich DP6-6307 is an acrylic latex with basic functionality manufactured by Ciba Specialty Chemicals Ltd Bindzil 40/130 is a silica colloid with 25 nm average particle diameter and 40% by weight solids, manufactured by Eka Chemicals AB The above mixture was applied using a reverse gravure roller onto the surface of a paper (Cham paper grade 871 (Cham is a Trade Mark), base weight 160 gsm), and the paper was dried for 70 seconds at 100° C. The coated weight was measured as 18 g/sq m.

After drying, the receiver media were cut into sheets and printed using a Stylus Photo EX printer (Stylus Photo Ex is a Trade Mark) (manufactured by Epson) using standard inks comprising aqueous dye solutions. The resultant prints dried rapidly and showed a very attractive satin finish. The colours were bright and the images were sharp.

Gloss was measured using a Glossmeter (Dr Lange). As expected, the gloss increased with the measuring angle:

| | Angle (Degrees) | | |
|---|---|---|---|
| | 25 | 60 | 85 |
| Measured Gloss (%) | 4.1 | 11.3 | 18.5 |

EXAMPLE 2

All the above sheets showed some degree of curl towards the receiver surface. A coating of Surcol 441 in acetone (15% solution) was applied to the rear side of the receiver media of Example 1 and dried to give a coat weight of 4 g/sq m. This had the effect of removing the curl.

Surcol 441 is an acrylic copolymer with an acid value of 120 (mg KOH per g polymer) manufactured by CIBA.

EXAMPLE 3

The same composition of coating as described in Example 1 was applied under similar conditions to a 160 gsm Mellotex Brilliant White (Mellotex is a Trade Mark) paper ex Tullis Russell.

After drying, the receiver media were cut into sheets and printed as described in Example 1. The resultant prints were found to dry rapidly, and showed a very attractive satin finish. The colours were bright and the images were sharp, except in areas of high ink loading, where some wicking was observed, following the paper fibres. Gloss measurements were as follows:

| | Angle (Degrees) | | |
|---|---|---|---|
| | 25 | 60 | 85 |
| Measured Gloss (%) | 4.5 | 14.8 | 25.7 |

EXAMPLE 4

The same composition of coating as described in Example 1 was applied under similar conditions to a 160 gsm Advocate Bright White (Advocate is a Trade Mark) paper ex Tullis Russell.

After drying, the receiver media were cut into sheets and printed as described in Example 1. The resultant prints were found to dry rapidly, and showed a very attractive satin finish. The colours were bright and the images were sharp, except in areas of high ink loading, where some wicking was observed, following the paper fibres.

| | Angle (Degrees) | | |
|---|---|---|---|
| | 25 | 60 | 85 |
| Measured Gloss (%) | 4.4 | 12.8 | 19.8 |

Examples 1, 2, 3 and 4 show that a suitable satin finish can be obtained by coating onto a range of papers. However, the final control of high ink loadings is variable. The paper used in the first example has a matt coating that obscures the structure of the paper fibres and therefore gives better control.

EXAMPLE 5

A coating solution was made up as follows:

| | |
|---|---|
| Bindzil 40/130 | 14 kg |
| Binder polymer (Surcol 441) | 140 g |
| Ammonia (0.91 S.G). | 142 g |
| DP6-6307 | 136 g |

Surcol 441 is an acrylic copolymer with an acid value of 120 (mg KOH per g polymer) manufactured by Ciba.

This was coated onto the same paper as used in Example 1 under the same conditions with a dry coat weight of 20 g/sq m, and printed as described in Example 1. The resultant prints were found to dry rapidly and showed a very attractive satin finish. The colours were bright and the images were sharp. However, the paper created a relatively large volume of dust when cut into sheets. It is believed that this is due to the low level of binder polymer in the system.

EXAMPLE 6

A coating solution was made up as follows:

| | |
|---|---|
| Binder polymer solution as in Example 1 was added with stirring to: | 10 g |
| Colloidal silica (Bindzil 40/130) | 100 g |

and the resultant mixture was coated using a 24 micrometer Meier bar onto the same paper as used in Example 1, and dried to give receiver media. The media had a satin finish and produced bright images, but tended to produce dust when cut.

EXAMPLE 7

A binder polymer solution was made up as follows:

| | |
|---|---|
| Binder polymer (Scripset 540) | 15 g |
| Ammonia (0.91 S.G). | 8.5 g |
| Water | 76.5 g |

4.7 g of this solution was added slowly with stirring to 26 g of colloidal silica (Bindzil 40/130). There was an increase in light scattering, but much less marked than in Comparative example 2 (below). To this solution 0.81 g of latex (DP6-6307) was added, slowly, with stirring.

The resultant solution was coated using a 24 micrometer Meier bar onto the same paper as used in Example 1, and dried. The resultant sheet had a satin finish and provided rapidly dried, bright, clear images on printing.

Scripset 540 is a styrene/maleic anhydride copolymer with an acid value of 185 mg KOH per g polymer, made by Monsanto.

EXAMPLE 8

Binder polymer solution as in Example 1 1.4 g was added slowly, with stirring to a mixture of

| | |
|---|---|
| Bindzil 40/130 | 5 g |
| Ammonia (0.91 S.G). | 0.1 g |

and then a further addition was made of

Polymer Dispersion (Vylonal MD1400) 1.4 g

The mixture was coated using a 50 micrometer Meier bar onto the same paper as used in Example 1, and dried. The resultant paper had a fine satin finish, although the colours of the image were less bright than those in Example 1.

Vylonal MD1400 is a 15% dispersion of a polyester polymer in water, manufactured by Toyobo.

EXAMPLE 9

Binder polymer solution as in Example 1 1 g was added slowly, with stirring to a mixture of

| | |
|---|---|
| Colloidal silica (Nyacol DP3890) | 5 g |
| Ammonia (0.91 S.G). | 0.1 g |
| Polymer latex (DP6-6307) | 0.4 g |

was then added with stirring, and the mixture coated onto the same paper as used in Example 1 using a 24 micrometer Meier bar. The resultant sheet had a satin finish, and produced a bright print, although the colours were not as intense as those in Example 1.

Nyacol DP3890 is a colloidal silica with 50 micrometer particle diameter and 50% solids manufactured by Eka Chemicals AB.

COMPARATIVE EXAMPLE 1

Colloidal silica (Bindzil 40/130) was coated using a 24 micrometer Meier bar onto the same paper as used in Example 1, and dried. The resultant sheet was matt and did not show a satin finish.

COMPARATIVE EXAMPLE 2

A binder polymer solution was made up as follows:

| | |
|---|---|
| Binder polymer (Scripset 520) | 15 g |
| Ammonia (0.91 S.G). | 20 g |
| Water | 75 g |

4.6 g of the above solution was added slowly, with stirring to a solution of

| | |
|---|---|
| Bindzil 40/130 | 26 g |
| Ammonia (0.91 S.G). | 1 g |

There was a large increase in the light scattering of the silica colloid, indicating that the colloid was aggregating in the presence of the polymer. To this cloudy solution was added:

Polymer latex DP6-6307 0.87 g

The above solution was coated using a 24 micrometer Meier bar onto the same paper as used in Example 1, and dried. The resultant sheet was matt, did not show a satin finish, and had a rough texture.

Scripset 520 is a styrene/maleic anhydride copolymer with an acid value 405 mg KOH per g polymer, made by Monsanto.

Light reflection measurements were carried out on media made as described in Examples 1, 2 and 3. For comparison, similar measurements were made on samples of commercially available glossy film, matt paper and two examples of commercially available satin finish inkjet papers 2PI 148 (Commercial Satin 1) and Premium Photo Quality Inkjet paper GP812 (Commercial Satin 2), both from ICI Imagedata.

Measurements were made by directing a laser onto the medium surface at an angle of 74 degrees to the normal, and then measuring the intensity of the reflected beam at the direct reflection angle of 74 degrees and at angles less than that value. A plot was made of the angular distribution of the reflected intensity, and the results are shown in FIG. 1. As expected, the glossy film provides very high reflection at the direct reflection angle, but this drops away very rapidly. The matt paper provides a very low level of reflection at all angles examined. The satin finish media (both conventional and in accordance with the invention) provide an intermediate level of reflection over a range of angles. Satin media can therefore be characterised as having a monotonic reduction in light reflection with viewing angle, whereby the decrease with angle is less marked than for a glossy surface. Therefore at angles of less than about 3 degrees, the glossy surface will reflect more light, whereas for greater angles the satin surface will reflect more light.

EXAMPLE 10

If sheets of the receiver media of Examples 1 to 9 are printed using a Stylus 2000 printer (Stylus 2000 is a Trade Mark) (manufactured by Epson) using pigment-based inks, then the images are found to be easily damaged by mechanical abrasion which rubs away the pigment particles on the printed surface.

EXAMPLE 11

Receiver media were prepared generally as described in Example 1 except the silica sol of the coating composition of Example 1 was replaced with Bindzil Z40K.

After drying, the receiver media were cut into sheets and printed using a Stylus 2000 printer using pigment-based inks. The resultant prints had a better appearance and were far more robust than similar prints made with this printer on sheets of the receiver media of Example 1.

Bindzil Z40K is a colloidal silica with 100 nm average particle diameter and 40% by weight solids, manufactured by Eka Chemicals AB.

EXAMPLE 12

A sheet of the receiver media of Example 1, a sheet of the receiver media of Example 11 and an uncoated base paper (Cham paper grade 871) were all printed using a Stylus Photo EX printer using dye-based inks. The reflection optical density of the printed image on each sheet was measured using a Gretag SPM50 meter from Gretag Macbeth (Gretag SPM50 is a Trade Mark).

| Optical Density | Base Paper | Example 1 (25 nm) | Example 11 (100 nm) |
|---|---|---|---|
| Cyan | 1.72 | 2.33 | 1.81 |
| Magenta | 1.28 | 1.49 | 1.14 |
| Yellow | 1.38 | 1.66 | 1.29 |
| Black | 1.54 | 2.15 | 1.73 |

It can be seen from the above that there is a significant increase in optical density when the paper is coated according to Example 1, but that this gain is lost when the paper is coated according to Example 11. This illustrates the significance of scatter when viewing images made from dye-based inks.

The invention claimed is:

1. A satin finish receiver medium for inkjet printing, comprising a porous substrate having on at least one surface thereof a porous ink-absorbent coating comprising colloidal particulate material and water-insoluble linear binder polymer, wherein the coating has been formed by application of a coating liquid comprising the colloidal particulate material and a solution of the water-insoluble linear binder polymer wherein the polymer is in the dissolved state wherein the binder polymer comprises a copolymer of a hydrophobic monomer and a monomer with carboxylic acid functionality, the polymer being soluble in dilute aqueous ammonia.

2. A receiver medium according to claim 1, wherein the binder polymer comprises an acrylic copolymer or a styrene maleic anhydride copolymer with an acid value of less than 405.

* * * * *